US008454457B1

(12) United States Patent
Woods et al.

(10) Patent No.: US 8,454,457 B1
(45) Date of Patent: Jun. 4, 2013

(54) GOLF TOOL SYSTEM

(76) Inventors: Delane M. Woods, Davie, FL (US); Ronald S. Woods, Davie, FL (US)

( * ) Notice: Subject to any disclaimer, the term of this patent is extended or adjusted under 35 U.S.C. 154(b) by 190 days.

(21) Appl. No.: 12/894,490

(22) Filed: Sep. 30, 2010

(51) Int. Cl.
*A63B 57/00* (2006.01)

(52) U.S. Cl.
USPC ..... 473/408; 15/106

(58) Field of Classification Search
USPC ..... 473/408, 406, 286; D21/793, 795
See application file for complete search history.

(56) References Cited

U.S. PATENT DOCUMENTS

| | | | | | |
|---|---|---|---|---|---|
| 2,857,608 | A | * | 10/1958 | Schwartz | 15/111 |
| D190,333 | S | * | 5/1961 | Gunderson | D4/118 |
| 5,022,650 | A | * | 6/1991 | Madock | 473/408 |
| 5,054,777 | A | * | 10/1991 | Borden et al. | 473/406 |
| D343,885 | S | * | 2/1994 | Wilkie, Sr. | D21/795 |
| D347,255 | S | * | 5/1994 | Kerr et al. | D21/795 |
| D347,872 | S | * | 6/1994 | Lyman | D21/795 |
| D348,500 | S | * | 7/1994 | Mortenson et al. | D21/795 |
| D353,645 | S | * | 12/1994 | Robidoux et al. | D21/795 |
| 5,388,824 | A | * | 2/1995 | Reimers | 473/406 |
| 5,419,551 | A | * | 5/1995 | Hoyt et al. | 473/406 |
| 6,030,298 | A | * | 2/2000 | Tate | 473/408 |
| D423,069 | S | * | 4/2000 | Hsu | D21/793 |
| 6,095,934 | A | * | 8/2000 | Ohama | 473/408 |
| 6,220,973 | B1 | * | 4/2001 | Hsu | 473/408 |
| 6,357,642 | B1 | * | 3/2002 | Marchessault et al. | 224/269 |
| D489,111 | S | * | 4/2004 | Perez et al. | D21/795 |
| 7,004,858 | B2 | * | 2/2006 | Bauley et al. | 473/408 |
| 7,083,535 | B1 | * | 8/2006 | Robinson | 473/408 |
| 7,269,869 | B1 | * | 9/2007 | Ruffino | 7/164 |
| 2001/0016526 | A1 | * | 8/2001 | Tate | 473/406 |
| 2002/0034992 | A1 | * | 3/2002 | Tate | 473/406 |
| 2008/0222815 | A1 | * | 9/2008 | Yurek et al. | 7/161 |
| 2012/0046122 | A1 | * | 2/2012 | Kwon et al. | 473/283 |

* cited by examiner

*Primary Examiner* — Steven Wong
(74) *Attorney, Agent, or Firm* — David P. Lhota, Esq.; Lhota & Associates, P.A.

(57) ABSTRACT

A golf tool system generally comprising a divot tool, a brush and a ball marker, the divot tool having a pair of spaced tines, a pocket formed in the body for holding the brush, a ball marker recess and a magnet cavity in the recess for holding and securing a magnet to releasably support a ball marker, the brush having a brush body with at least one thumb indent for enhancing the gripping of the brush body and bristles projecting from the lower end of the brush. Alternatively, the golf tool system comprises a divot tool and brush designed to hold the ball marker and mount to the bill of a baseball cap.

5 Claims, 5 Drawing Sheets

GOLF TOOL SYSTEM

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to a golf tool system, and more particularly, to a golf tool system having a divot tool with a securable and removable club cleaning brush and ball marker.

2. Description of the Background Art

A variety of divot tools are known in the golfing industry. These divot tools typically comprise a rigid body with one or two prongs. Ball markers for marking a golf ball's position on the green and brushes for cleaning golf club heads and ball markers are also known. The typical ball marker is removably snapped to a golf glove. Golf club brushes known typically comprise an elongated handle, a brush head and a strap for hanging it to a golf bag. As the divot tool, ball marker and brush are often needed simultaneously, it can be somewhat cumbersome to search for and carry all three items at the same time. If there existed a single tool for repairing divots, marking golf balls and cleaning club heads, it would provide a convenient solution to the problems associated with using multiple tools and would be well received. However, there is not a tool known that adequately addresses and resolves the shortcomings in the background art. Accordingly, there exists a need for single divot tool including a brush and ball marker. It is, therefore, to the effective resolution of the aforementioned problems and shortcomings of the prior art that the present invention is directed. The instant invention addresses this unfulfilled need in the prior art by providing a divot tool system as contemplated by the instant invention disclosed herein.

BRIEF SUMMARY OF THE INVENTION

In light of the foregoing, it is an object of the present invention to provide a golf tool system that removably secures a club head brush and ball marker.

It is also an object of the instant invention to provide a golf tool system that can be used for repairing divots on golf greens.

It is another object of the instant invention to provide a golf tool system that that can be used for marking golf balls on golf greens.

It is an additional object of the instant invention to provide a golf tool system that can be used for cleaning club heads.

It is a further object of the instant invention to provide a golf tool system that can clip to a hat or belt.

It is yet another object of the instant invention to a golf tool system that is cost-effective for mass production.

In light of these and other objects, the instant invention is a golf tool system generally comprising a divot tool, a brush and a ball marker. In the preferred embodiment, the divot tool comprises a pair of spaced tines, a pocket formed in the body for holding the brush, a ball marker recess and a magnet cavity in the recess for holding and securing a magnet. In the preferred embodiment, the brush comprises a brush body having thumb indents on both sides of the body for easy gripping and bristles projecting from the lower end. The instant invention also preferably comprises a retention clip that is securely placed in the pocket to secure the brush when it is inserted into the pocket.

In an alternative embodiment, the golf tool system comprises a divot tool and brush designed to hold the ball marker and mount to the bill of a baseball cap. In this embodiment, the brush comprises a body with a thumb indent on one side and flat surface on the other side, a magnet secured in the brush body so as to extend to both sides of the body and bristles. The alternative golf tool system also comprises a metal pin that attaches to the bill of a baseball cap for magnetically securing the brush on the bill. In another alternative embodiment, the divot tool body includes a clip attached to the divot tool. The clip allows the divot tool to be secured to the cloth of a pocket or to the bill of a baseball cap.

In accordance with these and other objects, which will become apparent hereinafter, the instant invention will now be described with particular reference to the accompanying drawings.

DETAILED DESCRIPTION OF THE INVENTION

Figure 1:
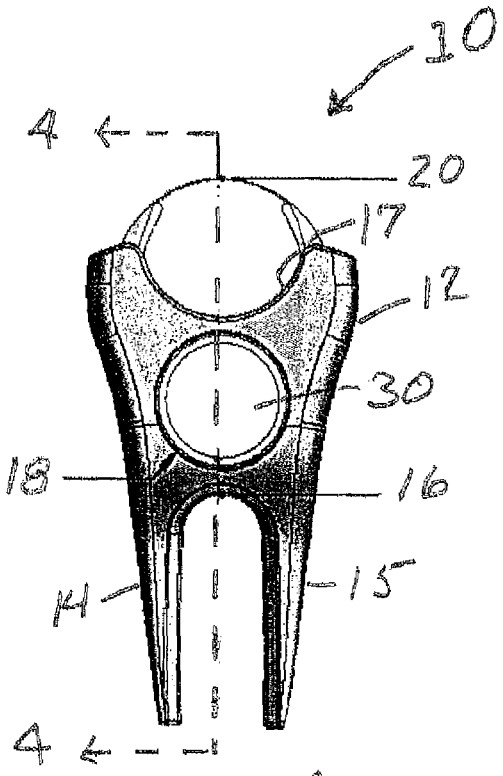
FIG. 1 is an elevational view of the preferred embodiment of the golf tool system showing the brush inserted in the divot tool and the ball marker attached to one side of the tool in accordance with the instant invention.
Figure 2:
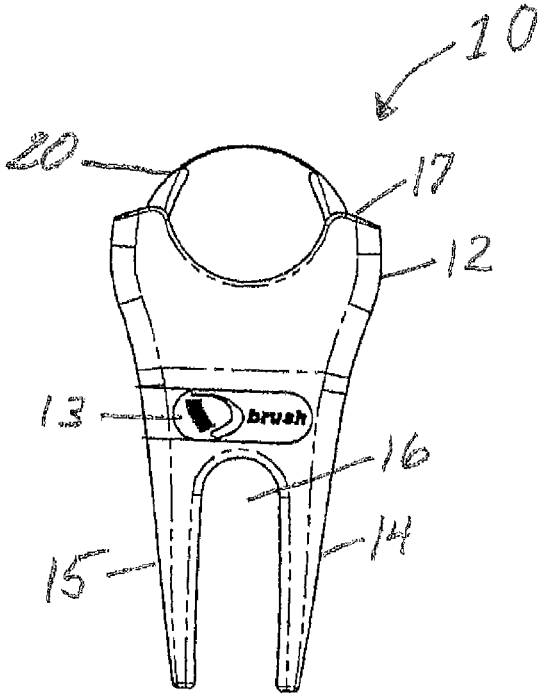
FIG. 2 is an elevational view of the preferred embodiment of the golf tool system showing the brush inserted in the divot tool and the opposite side of the divot tool in accordance with the instant invention.

With reference to the drawings, FIGS. 1 to 10 depict the preferred and alternative embodiments of the instant invention which is generally referenced as a golf tool system, system, tool and, or by numeric character 10. The golf tool system 10 generally comprises a tool or tool system designed for simultaneously holding the tools required for repairing divots, marking a golf ball on the green and cleaning club heads.

With reference to FIGS. 1-6, the golf tool system 10 comprises a divot tool 12, club brush 20 and ball marker 30 wherein the divot tool 12 is designed to hold the brush 20 and ball marker 30. The divot tool 12 preferably comprises a first tine 14, a second tine 15, a space 16 between the tines 14, 15, a brush pocket 17, a ball marker recess 18, a magnet cavity 19, a brush retention clip 26 and a magnet 32. The brush 20 comprises a brush body 21 defining at least one thumb indent 22 on one side and preferably an indent 22 on both sides and bristles 24 projecting from the lower end of the brush body 21. The indents 22 enhance the ability to grip and use the brush 20. The brush pocket 17 is sized to snugly receive the retention clip 26 and brush 20. The retention clip 26 has opposing biasing arms 27, 29 that are urged inward when placing the clip 26 in the pocket 17. The biasing arms 27, 29 spring outward when released so as to exert pressure against the side walls in the pocket 17 thereby securing the clip 26. The retention clip 26 secures the brush 20 when it is in the pocket 17 while allowing it to be removed when needed. The retention clip 26 may be further secured in the pocket 17 with a fastener, such as a screw, or an adhesive to insure it remains in the pocket 17 when the brush 20 is removed. The ball marker 30 is held in the recess 18 by the magnet 32, which is preferably secured in the magnet cavity 19 with an adhesive. The ball marker 30 is made from a metal for a magnetic attachment to the divot tool 12 within the recess 18. The opposite side of the divot tool body 12 may include indicia 13, such as a company name or logo.

Figure 7:
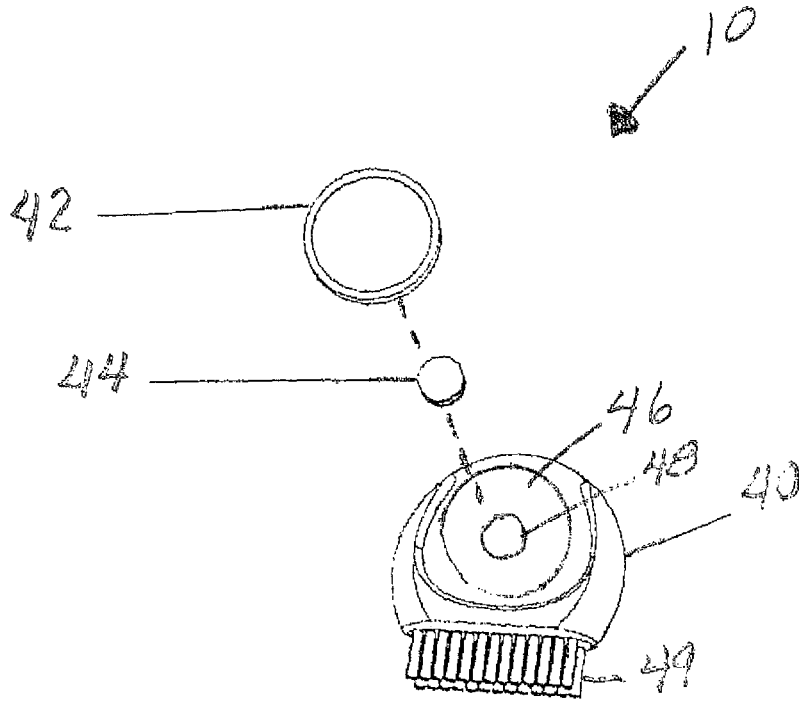
FIG. 7 is an exploded view of an alternative embodiment of the brush used in the divot tool system in accordance with the instant invention.
Figure 8:
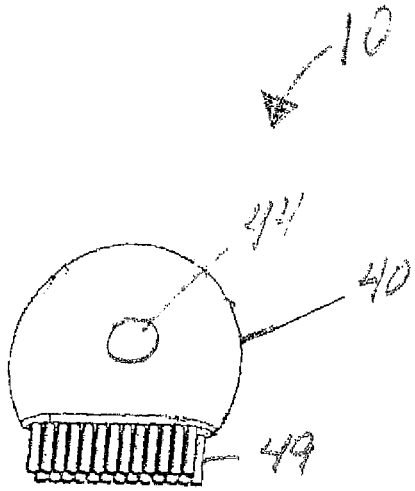
FIG. 8 is a rear perspective view of the alternative embodiment of the brush used in the divot tool system in accordance with the instant invention.
Figure 9:
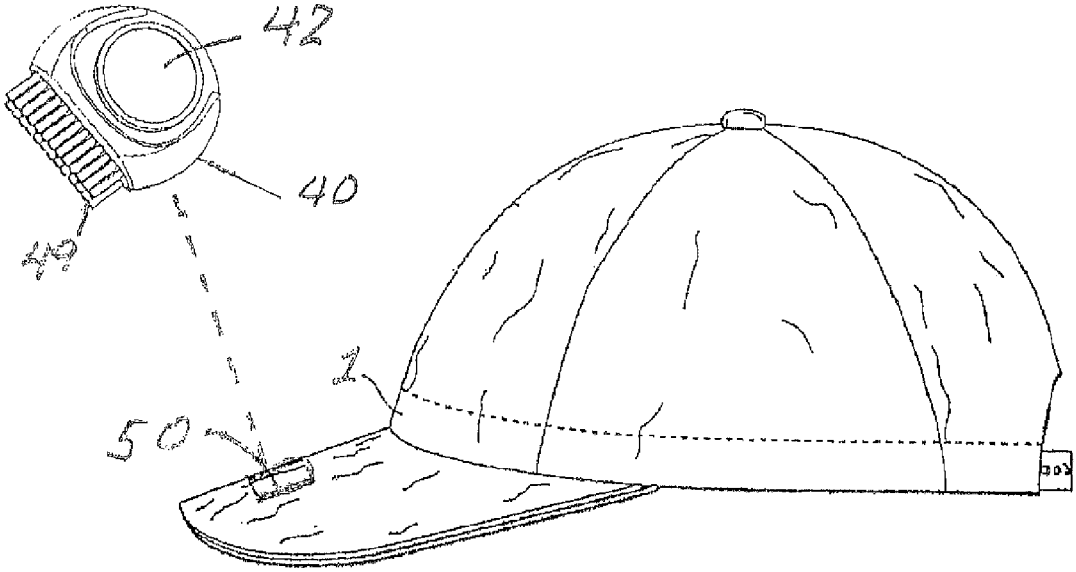
FIG. 9 is a perspective view of the alternative embodiment of the brush used in the divot tool system illustrating where it is mounted to the bill of a baseball cap in accordance with the instant invention.

With reference to FIGS. 7-9, in an alternative embodiment of the golf tool system 10 the ball marker 42 is mounted to a brush 40 and the brush 40 is mountable to the bill of a baseball cap 1. The alternative golf tool system 10 includes a brush 40 comprising a ball marker recess 46, a magnet cavity 48, a magnet 44, a ball marker 42 and bristles 49 projecting from the lower end of the brush 40, a metal pin or plate 50 that is securable to the bill of a baseball cap 1 and a divot tool 12, as disclosed in the preferred embodiment and shown in FIGS. 1-3, which may or may not have a ball marker recess 18, magnet cavity 19, magnet 32 or ball marker 30. The magnet 44 is secured in the magnet cavity 48 by way of a tight friction fit and, or an adhesive. The magnet cavity 48 extends between the front and rear surfaces of the brush body 40. The magnet 44 has complementary dimensions so that it extends between and provides a magnetic force on both surfaces of the brush 40. The ball marker side of the brush body 40 may comprise a thumb indent, however, the opposite is preferably flat. A flat surface is desired on one surface of the brush 40 for enhancing magnetic mounting of the brush 40 to the metal pin 50. The ball marker 42 must also be made from a metal material that is susceptible to magnetic forces. It should be noted that the instant invention 10 may be adapted for use with other types of hats.

Figure 3:
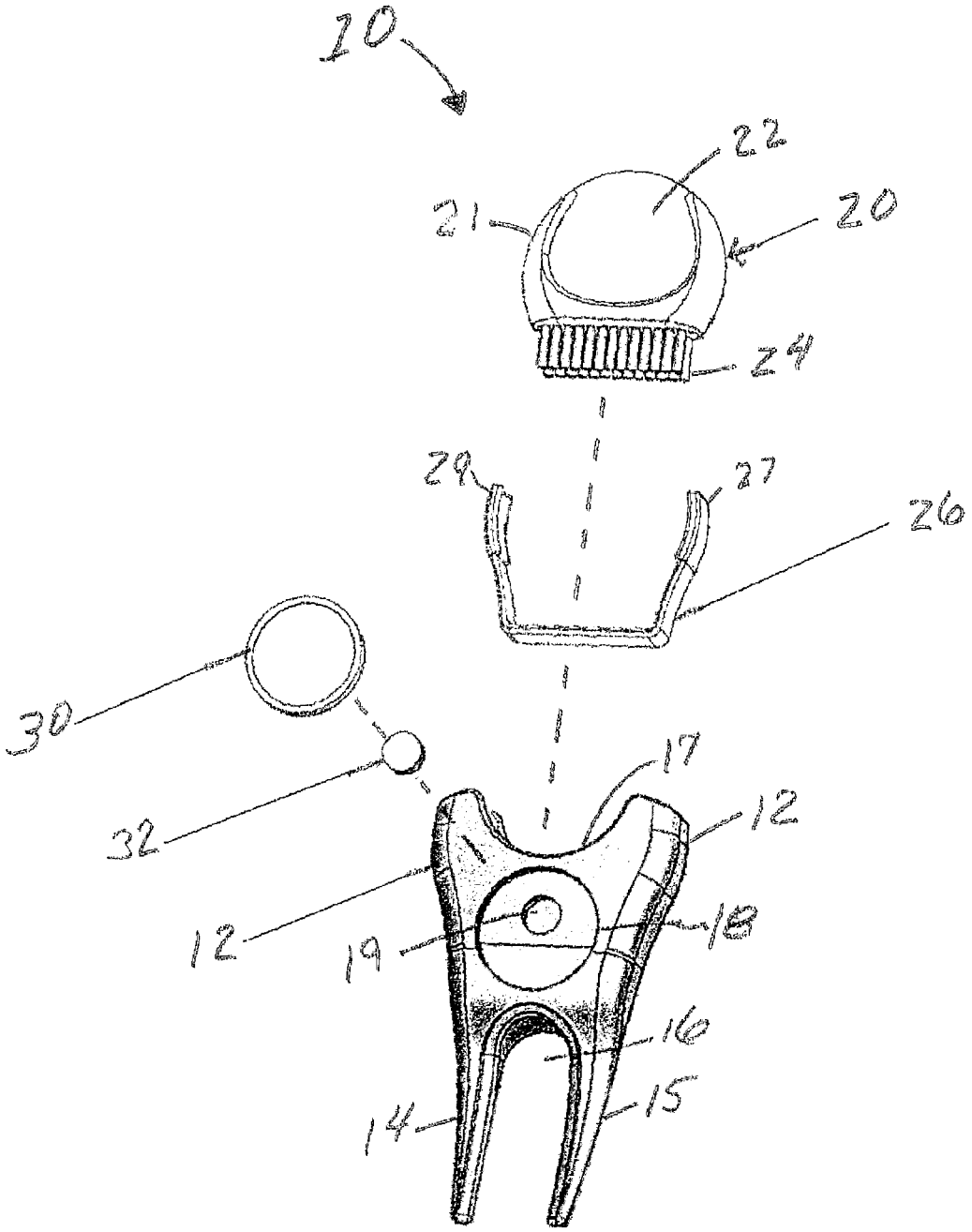
FIG. 3 is an exploded view of the preferred embodiment of the golf tool system in accordance with the instant invention.
Figure 4:
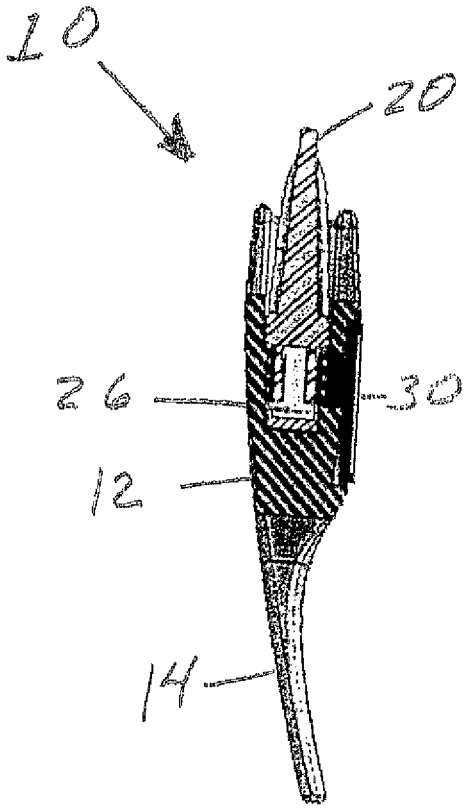
FIG. 4 is a cross sectional view of the preferred embodiment of the golf tool system of FIG. 1 taken along cross section lines 4-4 showing the brush inserted in the divot tool and ball marker attached to the tool in accordance with the instant invention.
Figure 5:
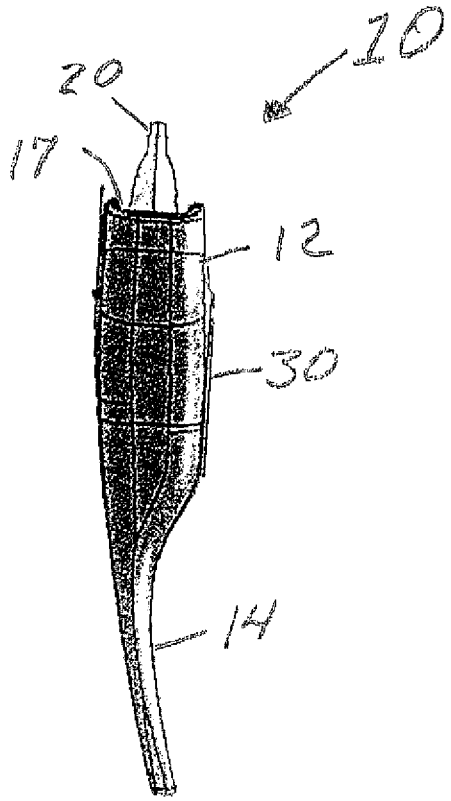
FIG. 5 is a side elevational view of the preferred embodiment of the golf tool system showing the brush inserted in the divot tool and the ball marker attached to one side of the tool in accordance with the instant invention.
Figure 6:
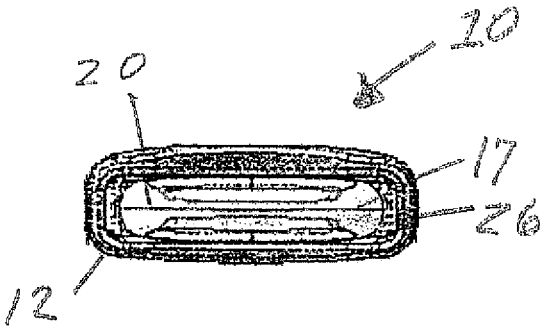
FIG. 6 is a top elevational view of the preferred embodiment of the golf tool system showing the brush inserted in the divot tool in accordance with the instant invention.
Figure 10:
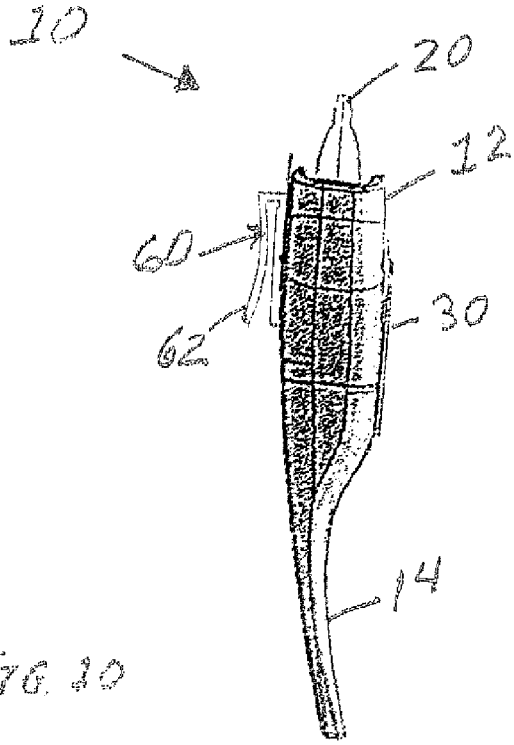
FIG. 10 is a side elevational view of another alternative embodiment of the golf tool system illustrating the divot tool having a clip for attaching the system to clothing, a belt or a hat.

With reference to FIG. 10, in another alternative embodiment, the golf tool system 10 comprises the same divot tool 12 and retention clip 26 as disclosed in the preferred embodiment and shown in FIG. 3, but also includes a mounting clip 60 secured to the rear surface of the divot tool 12. The mounting clip 60 has a biasing arm 62 for clipping to the cloth of a pocket or hat, to a belt or to the bill of a hat. The mounting clip 60 is preferably secured to the body of the divot tool 12 with a fastener. This alternative embodiment of the instant invention 10 may comprise the preferred brush 20 and ball marker 30 design or the alternative brush 40 and ball marker 42.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A golf tool system, said system comprising:

a divot repair body comprising a first end and a second end and at least one time projecting outward from said second end;

a brush comprising a brush body haying a unitary construction and bristles projecting from said brush body;

a ball marker adapted for releasable mounting to said brush body;

means for releasable support of said ball marker;

said divot repair body comprising a brush pocket defined in said first end for removably holding said brush; and a clip disposed in said brush pocket, said clip having at least one biasing arm having spring retention for releasably securing said brush body in said brush pocket.

2. A system as recited in claim 1, wherein said clip comprises:

two opposing biasing arms having spring retention for releasably securing said brush body in said brush pocket.

3. A system as recited in claim 1, wherein said means for releasable support of said ball marker comprises:

a magnet in mechanical communication with said brush body.

4. A system as recited in claim 3, further comprising:

means, in mechanical communication with a hat, for magnetically communicating with said magnet to releasably support said brush.

5. A system as recited in claim 1, further comprising:

a clip secured to said pivot repair body for releasably mounting said pivot repair body to clothing related articles.

* * * * *